United States Patent [19]

Lawson

[11] 4,211,281

[45] Jul. 8, 1980

[54] ARTICULATED PLURAL WELL DEEP WATER PRODUCTION SYSTEM

[75] Inventor: John E. Lawson, Houston, Tex.

[73] Assignee: Armco, Inc., Middletown, Ohio

[21] Appl. No.: 14,036

[22] Filed: Feb. 22, 1979

[51] Int. Cl.[2] ..... E21B 33/035

[52] U.S. Cl. ..... 166/345; 166/362; 166/366; 137/236 S

[58] Field of Search ..... 166/366, 344–348; 175/7; 405/197; 137/236

[56] References Cited

U.S. PATENT DOCUMENTS

| | | | |
|---|---|---|---|
| 3,311,142 | 3/1967 | Bergstrom | 137/236 X |
| 3,500,906 | 3/1970 | Peterson | 166/0.6 |
| 3,517,735 | 6/1970 | Fairbanks | 166/0.5 |
| 3,517,738 | 6/1970 | Peterson | 166/0.6 |
| 3,688,840 | 9/1972 | Curington et al. | 166/344 X |
| 4,023,619 | 4/1975 | Marquaire et al. | 166/366 |
| 4,126,008 | 11/1978 | Dixon | 405/27 |

OTHER PUBLICATIONS

Snyder, "New Concept Unveiled for Subsea Completion, Production", World Oil, Sep. 1976, pp. 41–45.

Chates & Richardson "Subsea Manifold System" O.T.C. May 1974, Paper No. S57140020.

Armco Bulletin No. 629 "National Subsea Production Systems" May 1978.

*Primary Examiner*—Ernest R. Purser

*Attorney, Agent, or Firm*—Arnold, White & Durkee

[57] ABSTRACT

A subsea production system for handling produced well fluids from a number of individual deep water wells drilled in different parts of a field and providing the produced well fluids to a surface production platform through a central riser. The apparatus includes a manifold section on a multi-faceted central manifold base. A plurality of booms are articulated to the manifold base at the periphery thereof, with a single boom being articulated to each facet. Each boom extends radially outward from the manifold base and has a temporary guide base and subsea tree mounted to the outer end. Extending along each boom from the manifold base is a preinstalled flow line which terminates in a connection to the tree. The lengths of the booms are alternated to provide a predetermined minimum spacing from the center of each well site to any other well site or the manifold base. Alignment of the manifold section with respect to the manifold base and hard guidance in landing the manifold section is provided by a downwardly facing, pyramid shaped funnel on the manifold and an upwardly extending pyramid shaped structure on the manifold base which is insertable in the funnel.

21 Claims, 3 Drawing Figures

ARTICULATED PLURAL WELL DEEP WATER PRODUCTION SYSTEM

FIELD OF THE INVENTION

This invention relates to subsea production systems; and more particularly, it relates to a deep water subsea production system which provides for the production of several individual wells drilled in different parts of a field through a central production manifold and riser.

BACKGROUND OF THE INVENTION

In producing developed fields, it is necessary, prior to transporting well fluids from an offshore location to storage or refining facilities, to separate the gas, oil, water and other components of produced well fluids. Also, it is often necessary to control and meter the production of wells. Initially, this was done using conventional wellhead equipment from a fixed platform. Later, as subsea production technology advanced, the wellhead equipment was installed on the ocean floor and risers installed between the wellhead and the surface production platform.

As offshore oil field operations moved into deeper waters, i.e. 400 to 1,000 feet depths, semi-submersible vessels supplanted fixed structures as the production platform. Also, as a part of economic justification for the additional expense attendant operations in these deeper waters, the fields developed were larger, requiring that number of individual wells be drilled in different parts of the field. Thus, the arrangement for producing deep water fields became one wherein a number of satellite wells, each with its own subsea wellhead equipment, are interconnected with flow lines to a central manifold and riser. The manifold and riser serve to conduct crude oil to processing tanks on the semi-submersible and to a swivel buoy mooring for loading into a tanker. The equipment for implementing the satellite system has heretofore consisted of a number of satellite production trees and a production manifold and riser system.

In a satellite production system, each well is independently established by drilling a borehole and then landing the well control equipment thereon. In establishing a satellite well, a temporary guide base is placed on the ocean floor to compensate for possible sloping of the floor and to provide guidance for drilling the pilot hole. Wire guidelines are connected to the guide base at the surface prior to lowering it to the ocean floor. These wire guidelines are used in guiding re-entry to the well during all subsequent steps in establishing a producing well. Such wire line guides may be attached to the guide base in several different ways, for example, spears adapted for shear release from a receptacle or adapted release from spring-loaded segments for non-shear retention.

After the drill string is retrieved, an outer conductor is entered into the well bore and held in place within radial latches built into the center ring of a permanent guide base and which attach to a suspension joint on the outer conductor. The permanent guide base also includes removable corner posts, each of which has a longitudinal slot to permit insertion therein of the four wire guidelines attached to the temporary guide base. The outer conductor is jetted into place, and a guide assembly with the drill string held therein is lowered to re-enter the bit into the well bore.

Prior to the beginning of drilling of a hole for an inner conductor string, a lower riser package assembly is lowered and latched to the outer conductor. Drilling of a smaller casing hole is then performed through the riser, with the riser providing directional control to bleed off any shallow pressured sands penetrated. The lower riser assembly is retrieved upon completion of the casing hole, and the inner conductor string is run into the borehole and set.

The subsea wellhead equipment, or Christmas tree, is then installed. The equipment is made up of several components, the lowermost component being a conductor which attaches to the inner conductor and is capable of being latched or unlatched remotely by means of a hydraulic control system. Atop the connector is a block valve assembly which includes valves for providing outlet flow paths for the crude. The wellhead equipment is mounted on a guide frame adapted for the wire line guidance onto the permanent guide base.

The central manifold and riser of a satellite production system is interconnected with the individual wells by flow lines independently laid. Typically, dual flow lines between each well and the central manifold are used. The attachment of flow lines to the wellhead equipment is by diver manipulated, hydraulically actuated connectors. Occasionally, flow line connection is made utilizing a fixed spool made up on the site using a diver fabricated jig.

The central manifold has two main sections. The lower section is called the permanent base; it provides the attachment points for the flow lines. Mounted on the permanent base section are stab receptacles for landing the second section, the manifold. The upper manifold section contains all of the hydraulic connectors for securing the manifold section to the permanent base and for interconnecting with the production riser. The manifold section also includes several valves for directing the flow of crude oil to various riser tubes.

The riser consists of a central tube and several nonintegral, externally guided tubes, each having a smaller diameter than the central tube. The smaller tubes carry high pressure crude from the manifold to the deck of the semi-submersible; and the central tube conducts processed crude at low pressure down to a swivel buoy moored loading facility.

Although the establishment of a producing subsea in the aforementioned manner proceeds quite well in waters having depths up to about 1,000 feet, when it is necessary to establish a subsea production system for large fields in substantially deeper waters, i.e. 3,000 feet and deeper, the utilization of wire line guidance and diver attachment of flow line connections is not feasible. In waters of such substantial depth, it becomes necessary to employ a dynamic guidance system utilizing sonar and T.V. monitoring of re-entry to the well, landing of wellhead equipment, and connection of flow lines.

As can readily be appreciated, the making of flow line connections by remote control from the surface is very tedious and time consuming. Also, even with visual contact provided by T.V. monitoring, the landing of wellhead equipment becomes a much more complicated endeavor.

SUMMARY OF THE INVENTION

In accordance with the present invention, there is provided apparatus for subsea production of fluids from a plurality of individual wells drilled in different parts of a field located in deep water, which production is through a central riser leading to a surface platform such as a semi-submersible. Specifically, the instant invention provides apparatus for producing subsea oil or gas wells in water depths which require the use of sonar/TV guidance systems for making re-entry to a well or landing well control equipment at the well site.

In accordance with this invention, there is provided subsea well fluid production apparatus which comprises a central manifold base having flow line connectors thereon, and an elongated boom for each well, which boom is affixed to the base at one end and carries a temporary guide base at the other end, with a flow line system and control bundle extending along each boom from a connector on the central manifold base. Preferably, each boom is affixed in an articulating manner at locations along the periphery of the manifold base. Similarly, each temporary guide base may also be mounted in a manner providing for articulation between it and its respective boom.

In accordance with the present invention, flow lines between the wellhead equipment for Christmas tree and the central production manifold are pre-installed and tested prior to submergence of the production apparatus.

The provision for articulation between each boom and the central manifold base permits the manifold base to be leveled easily and permits the entire structure to readily conform to variations in the topograhy of the ocean floor where the apparatus is to operate.

To facilitate landing of a manifold section onto the manifold base, means may be included in accordance with the present invention to provide for vertical, lateral and rotational orientation and guidance of the manifold section into position. Furthermore, means for providing orientation and guidance may be in the form of hard guidance such as a pyramid shaped structure mounted on the central manifold base and extending upwardly therefrom. Yet further in accordance with the present invention, the manifold section to be landed on the manifold base may include a downwardly facing, pyramid shaped funnel secured to the lower end thereof which engages the pyramid shaped hard guidance structure on the manifold base.

The central manifold base is preferably of a multi-faceted geometric configuration, with each boom being articulated to the base at one facet. The number of facets is not critical; the number will generally be determined according to the number of individual wells to be produced.

Although each boom may be rigidly secured to the central manifold base, it is preferable that the booms be articulated providing movement in at least a vertical plane, with articulation preferably being provided by a hinge. However, universal articulation of each boom is also acceptable, using a swivel or a ball joint connection. The length of each boom should generally be such that a predetermined minimum spacing between the center of each well site and the manifold base is maintained. Furthermore, the lengths of adjacent beams preferably differ to provide a predetermined minimum radial spacing between the centers of the well sites.

The temporary guide base mounted at the end of each boom may be either rigidly mounted or mounted in a manner providing articulation between the guide base and the boom, thereby enhancing the adaptability to variations in ocean floor topography. Each temporary guide base establishes a well site, and is adapted to receive thereon a subsea tree having the usual well control equipment. In connection with the landing of a subsea tree on the temporary guide base, a subsea tree is provided with means for orienting the tree on the temporary guide base. Such orienting means may, for example, comprise a downwardly opening funnel, which funnel includes an extended skirt portion on the flow line side, notch therein, providing for engagement with the boom.

The pre-installed flow lines extending along the length of each boom terminate near the end of each boom, and preferably terminate in vertical stab-in flow line connector receptacles. Also, the subsea trees to be landed on a temporary guide base preferably include a connector for making an interconnection with the stab receptacle of each respective flow line upon landing.

Further in accordance with the present invention, a control pod receptacle may be provided on each boom in assocation with the vertical stab flow line connector receptacles. The control pod receptacle is adapted for remotely controlled engagement by an hydraulic ram carried on the subsea tree for pulling a corresponding flow line connector stab-in receptacle into position. When such operation is employed, the flow line receptacle moves vertically by flexure of the flow lines.

These and other features of the present invention are more comprehensively discussed in the detailed description of an illustrative embodiment which is presented below.

BRIEF DESCRIPTION OF THE DRAWINGS

A more complete appreciation of the invention may be had by reference to the accompanying drawings of an illustrative embodiment of the invention which is described in detailed in the description which follows, wherein.

DETAILED DESCRIPTION OF AN ILLUSTRATIVE EMBODIMENT

Figure 1:
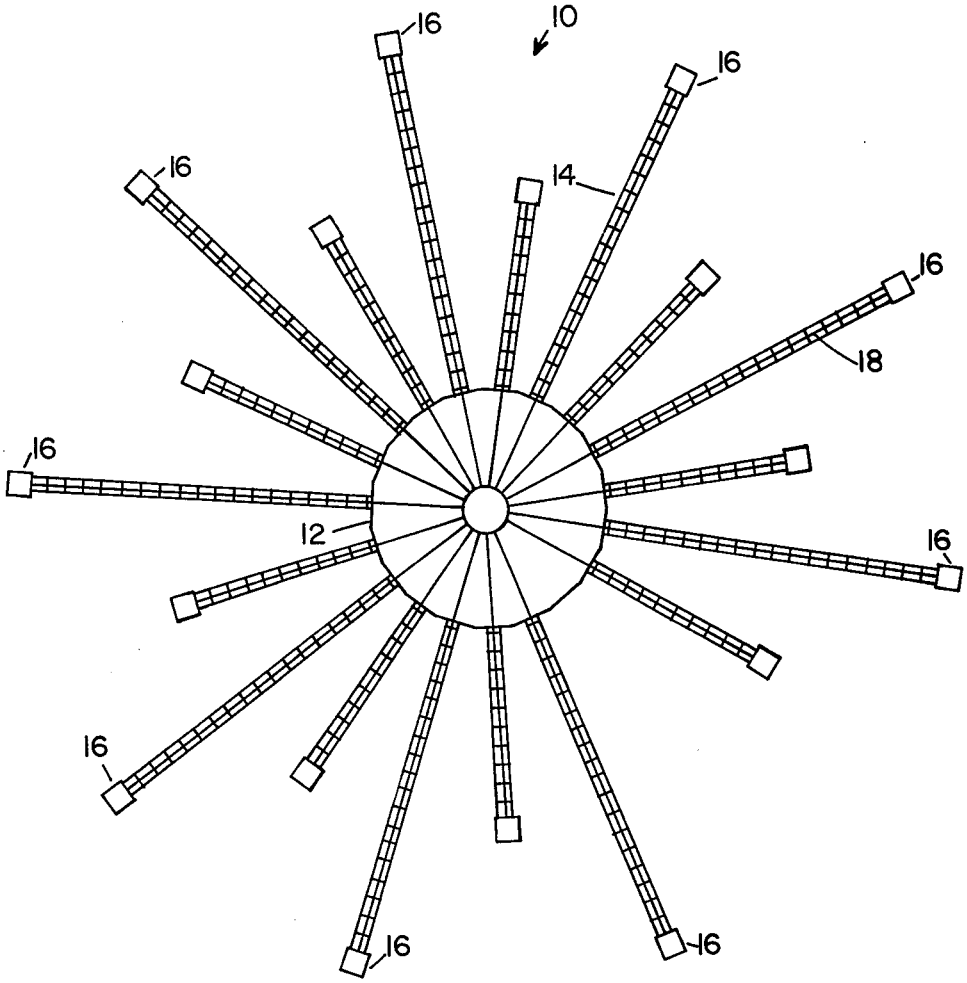
FIG. 1 is a diagrammatic plan of a deep water subsea production apparatus.

Referring to FIG. 1, there is shown in a plan view, a diagram of a subsea production system for producing a number of individual wells drilled in different parts of a field. The overall structure is generally indicated by the reference numeral 10. The subsea production apparatus 10 is suitable for submergence in a body of deep water, i.e. 1,000 feet or deeper, and provides for the production of several wells through a central riser. Preferably, the subsea production apparatus 10 is utilized in conjunction with a semi-submersible floating vessel.

Subsea production apparatus 10 includes a central manifold base 12, which is of a multi-faceted geometric configuration, the number of facets thereof depending upon the number of wells to be produced. In the apparatus illustrated in FIG. 1, base 12 is substantially circular, comprising nineteen facets. Therefore, subsea production apparatus 10 provides for the handling of produced well fluids from eighteen wells. The nineteenth segment may be reserved for the establishement of a flow line leading to a swivel buoy mooring for loading tankers with crude oil processed on board the semi-submersible and pumped to the tanker through a conduit of the riser.

Attached to each facet of base 12 is a boom, each boom being labeled with the reference numeral 14 and all booms being of similar structure. Preferably, each boom is attached to the manifold base 12 by either a hinge or a swivel coupling, which provides the boom with articulation. Movement of each boom in a vertical plane relative to manifold base 12 facilitates leveling of the manifold base and permits the structure to readily conform to variations in ocean floor topography. Also, it is preferable that each boom be articulated to the manifold base at the periphery thereof, as shown, to enhance the benefits accrued through the articulation of the booms relative to the manifold base.

At the end of each boom, there is mounted a temporary guide base 16. The manner of attachment of a temporary guide base to the end of a boom is preferably a hinge or a swivel, which provides articulation betweeen a boom and the temporary guide base. Each temporary guide base 16 is of conventional structure, and may, for example, be one such as that manufactured by NATIONAL SUPPLY COMPANY, Division of Armco, Inc., of Houston, Tex. Each temporary guide base establishes a well site and defines particular locations within a field where wells are to be drilled.

As shown in FIG. 1, booms 14 extend radially outward from manifold base 12. Moreover, adjacent booms differ in length; however, each boom is of a length sufficient to provide a predetermined minimum spacing between the center of each well site and the manifold base. Furthermore, the difference in length between adjacent booms is made to provide for the maintenance of a predetermined minimum radial spacing between the centers of the well sites.

Extending along each boom 14 from manifold base 12 is at least one flow line 18. Preferably, each flow line terminates near the end of the boom and is provided with a stab-in flow line connector receptacle (not shown). Flow lines 18 are pre-piped and installed on shore at the fabrication facility where the manifold base and booms are constructed. Accordingly, the flow lines may be tested and certified prior to submergence of the subsea production apparatus 10 underwater. The provision of pre-installed flow lines, of course, obviates the problem of laying flow lines and a control bundle between underwater well sites and a central underwater manifold and the problems attendant the making of flow line interconnections by remote control using T.V. monitor guidance.

Figure 2:
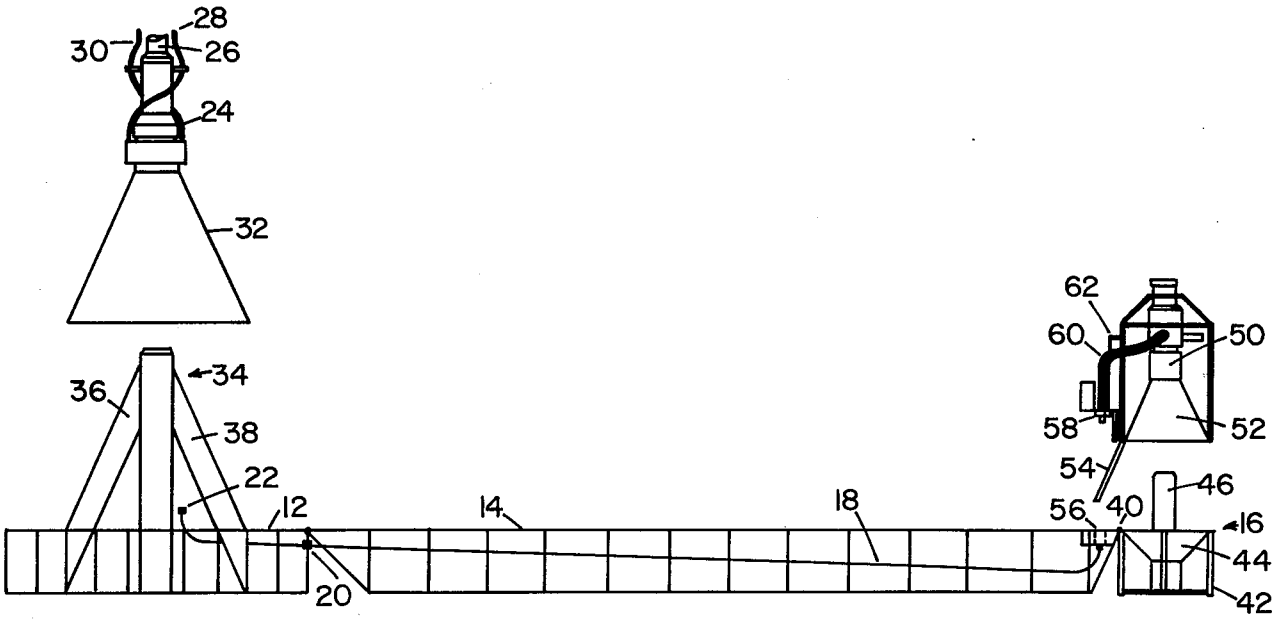
FIG. 2 is a diagrammatic elevation view of the structure shown in FIG. 1, including an illustration of the manifold section and a subsea tree.

Referring now to FIG. 2, there is shown in an elevation view diagram the subsea production apparatus 10 shown in FIG. 1. For purpose of simplicity, only a single boom 14 is shown. As can be readily appreciated, manifold base 12 and boom 14 are of an open truss type of construction. As is further illustrated in FIG. 2, manifold base 12 includes flow line connectors 20 for making a fluid interconnection with flow line 18 and stab receptacles 22 which are provided for interconnection with manifold section 24, also shown in FIG. 2.

Manifold section 24 is adapted to be landed on manifold base 12 and includes connectors which interconnect with stab receptacles 22 and the production riser. As shown, manifold section 24 is designed for use with a riser comprising a central tube 26 and non-integral, externally guided tubes 28, 30. The smaller tubes 28, 30 carry high pressure crude from the manifold to the deck of semi-submersible, and the larger tube 26 carries processed crude low pressure down to a pipeline leading to a swivel buoy mooring. Manifold section 24 also includes a number of hydraulically controlled valves which direct the flow well fluid to riser tubes 28, 30.

Alternatively, manifold section 24 may interconnect with a riser comprising structure in accordance with that shown and described in U.S. Pat. No. 4,040,264.

In landing manifold section 24 on manifold base 12, sonar and T.V. guidance is first utilized to provide initial guidance in locating the base and positioning the manifold section over the base. Once manifold section 24 is positioned in close proximity to base 12, the manifold is lowered with guidance means interposed between manifold section 24 and base 12 providing final guidance to locate the manifold section in a predetermined lateral position relative to the base. In accordance with the present invention, the guidance means provides hard guidance, meaning that a contacting relation is formed between structure on the manifold and structure on the base. In the illustrative embodiment shown in FIG. 2, hard guidance is provided in a form of a downwardly facing pyramid shaped funnel 32 secured to the lower end of manifold section 24 and a corresponding pyramid shaped structure 34 mounted on and extending upwardly from base 12.

Pyramid guidance structure 34 comprises four inclined structural members, two of which are shown, members 36, 38. These members are arranged on base 12 to have a pyramid shape corresponding to the pyramid shaped internal opening of funnel 32. The utilization of a pyramid shaped guidance means affords not only lateral guidance and alignment of manifold section 24 on base 12, but also affords rotational alignment assuring that connectors carried on the manifold, which are to mate with stab-in receptacles 22, are properly oriented for making that designated connection.

With continued reference to FIG. 2, attention is now directed to the outer end of boom 14. As shown, temporary guide base 16 is articulated to the end of boom 14 by means of a hinge connection 40, which permits guide base 16 to be tiltable, thereby compensating for possible ocean floor slope. Guide base 16 includes a frame structure with post extensions on the bottom for resting on the ocean floor. An inverted conical section 44 is centrally disposed within frame 42 and provides guidance into the well bore. Temporary guide base 16 also includes tank sections which can be filled with weight material to aid in securing the base to the ocean floor. After the drilling of a well using conventional subsea wellhead equipment with sonar and TV guidance, there will be extending upwardly from guide base 16 a wellhead body 46, as shown.

To provide for the controlled production of well fluids from each well, a subsea Christmas tree, generally designated by the reference numeral 50, is landed on temporary guide base 16 around wellhead body 46. Subsea tree 50 comprises several components including a tree connector, which is capable of being latched or unlatched remotely through a hydraulic controlled system, and a composite block valve assembly. Preferably, the block valve assembly includes dual wing valves which offer two paths for well fluid flow to the central manifold.

To facilitate landing of subsea tree 50 on temporary guide base 16, sonar/TV guidance is first utilized to position the tree in proximity to wellhead body 46. For final guidance of subsea tree 50, a downwardly facing funnel, shaped either as a cone or a pyramid, is secured to the lower end of tree 50. To properly orient subsea tree 50 on temporary guide base 16 and assure attachment of flow line 18 to connectors on tree 50, a portion 54 of funnel 52 is extended on the flow line side of the tree to provide secondary guidance means for properly situating the tree on the guide base.

At the outer end of boom 14 adjacent the point of interconnection between boom 14 and temporary guide base 16, there is located a block 56 which has mounted therein a vertical stab-in connector into which flow line 18 terminates. Upon landing of subsea tree 50 in proper orientation on guide base 16, stab-in connector 58, which is in fluid communication with the block valve assembly of tree 50 through interconnecting tube 60, is positioned over the flow line connector receptacle carried in block 56. To bring stab-in connector 58 and the receptacle in block 56 into connection, a hydraulic ram assembly 62 is provided on subsea tree 50. By means of remote actuation, the ram is locked onto block 56 and retracked to pull connector 58 and the receptacle in block 56 together making the desired flow line attachment to tree 50.

Figure 3:
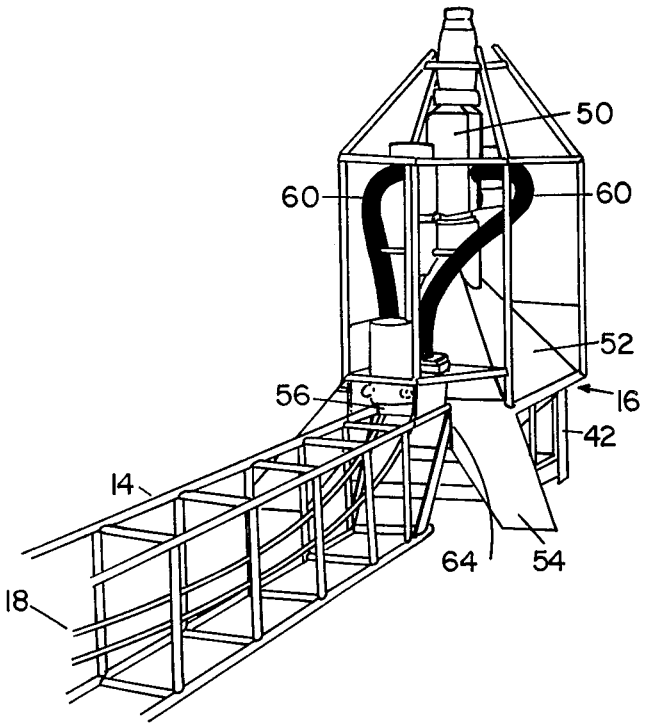
FIG. 3 is a perspective view of a subsea tree landed on a temporary guide base which is mounted at the end of a representative one of the booms on the structure.

Referring now to FIG. 3, there is shown a perspective view of an outer end portion of a boom 14 and temporary guide base 16 with subsea tree 50 landed thereon in its proper orientation. As shown in FIG. 3, the flow line arrangement between the central manifold base comprises a dual flow line arrangement, since either a single flow line or dual flow lines may be utilized. From the perspective view of FIG. 3, the secondary hard guidance means utilized in landing tree 50 on guide base 16 can be more readily viewed. As shown, the extended portion 54 of funnel 52 has formed therein a notch 64 which is adapted to receive therein, by lateral insertion, the end of boom 14. Thus, in landing tree 50 on temporary guide base 16, lateral alignment and positioning between tree 50 and guide base 16 is provided by funnel 52, and rotational orientation for tree 50 is provided by the extended skirt portion 54 and the notch 64 therein.

It will be appreciated from the foregoing description of the illustrative embodiment shown in FIGS. 1–3 that although being particularly advantageous in deep water situations, the subsea production apparatus of the present invention may be successfully utilized in any water depth. Moreover, the apparatus is relatively lightweight and therefore cost effective. Articulation between the booms and the central manifold base allows for a manifold base to be easily leveled, with the structure readily conforming to variations in ocean floor topography. Finally, a major advantage provided by this invention is the provision for pre-piped flow lines which are tested prior to submergence of the apparatus, thereby obviating the tedious work, when in deep water, of attaching flow lines to the subsea trees.

The foregoing description of the present invention has been directed to a particular embodiment thereof for purposes of explanation and illustration. It will be apparent, however, to those skilled in this art that many modifications and changes in the embodiment shown may be made withoutdeparting from the teachings of the present invention. Accordingly, that subject matter which applicant regards to be his invention is set forth in the following claims.

What is claimed is:

1. Apparatus for subsea production of fluids through a central riser and manifold from a plurality of individual wells drilled in different parts of a field in deep water which comprises:

a central manifold base having flow line connectors thereon;

an elongated boom for each well to be produced in a field, each boom being articulated at one end to the manifold base at locations along the periphery of the base;

a temporary guide base mounted to the other end of each boom for establishing a well site; and a flow line extending along each boom from a flow line connector on the central manifold base.

2. the subsea production apparatus of claim 1, wherein:

the central manifold base is of a multi-faceted geometric configuration, and each boom is articulated to the base at one facet thereof.

3. The subsea production apparatus of claim 1, which further comprises:

means carried on the manifold base for providing hard guidance in positioning of a manifold section on the manifold base.

4. The subsea production apparatus of claim 1, which further comprises:

means for providing lateral and rotational orientation and guidance of a manifold section into position on the manifold base.

5. The subsea production apparatus of claim 1, which further comprises:

a pyramid shaped structure mounted on the central manifold base for providing lateral and rotational orientation and guidance of a manifold section into location on the manifold base.

6. The subsea production apparatus of claim 1, which further comprises:

means for mounting the temporary guide base to the end of the boom to provide articulation therebetween.

7. The subsea production apparatus of claim 1, wherein:

the length of adjacent booms differ to provide a predetermined minimum radial spacing between the centers of the well sites.

8. The subsea production apparatus of claim 1, wherein:

the length of each boom provides a predetermined minimum spacing between the center of each well site and the manifold base; and the lengths of adjacent booms differ to provide a predetermined minimum radial spacing between the centers of the well sites.

9. The subsea production apparatus of claim 1, wherein each flow line terminates in a vertical stab flow line connector receptacle.

10. The subsea production apparatus of claim 9, wherein the vertical stab flow line connector is vertically movable by flexure of the flow lines.

11. Apparatus for subsea production of fluids through a central riser from a plurality of individual wells drilled in different parts of a field in deep water, which comprises:

a central manifold base having flow line connectors and stab receptacles thereon;

a manifold section to be landed on the manifold base and having connectors for making a connection with the stab receptacles on the base and with a production riser;

an elongated boom for each well to be produced in a field, each boom being articulated at one end to the manifold base at spaced locations along the periphery of the base and extending radially outward from the base;

a temporary guide base mounted to the other end of each boom for establishing a well site;

a pre-piped flow line extending along each boom from a flow line connector on the central manifold base and terminating in a flow line stab connector receptacle; and a subsea tree for each well to be landed on a temporary guide base and having a connector for making an interconnection with the stab receptacle of a respective flow line.

12. The subsea production apparatus of claim 11, which further comprises:

means carried on the manifold base for providing hard guidance of the manifold section into position on the manifold base, said guide means providing lateral alignment of the manifold section with respect to the manifold base during landing of the manifold section.

13. The subsea production apparatus of claim 11, wherein:

the manifold section includes a downwardly facing, pyramid shaped funnel secured to the lower end thereof; and the central manifold base includes an upwardly extending pyramid shaped structure for engaging the funnel on the manifold section to provide lateral alignment and rotational orientation and the hard guidance of the manifold section during landing of the manifold section into position on the manifold base.

14. The subsea production apparatus of claim 11, wherein each subsea tree includes:

means for orienting the tree on its temporary guide base.

15. The subsea production apparatus of claim 11, wherein each boom includes a control pod receptacle.

16. The subsea production apparatus of claim 11, wherein:

the central manifold base is of a multi-faceted geometric configuration; and each boom is articulated to the base at one facet thereof.

17. The subsea production apparatus of claim 11, which further comprises:

means for mounting the temporary guide base to the end of the boom to provide articulation therebetween.

18. The subsea production apparatus of claim 11, wherein:

the length of each boom provides a predetermined minimum spacing between the center of each well site and the manifold base; and the lengths of adjacent booms differ to provide a predetermined minimum radial spacing between the centers of the well sites.

19. Apparatus for subsea production of fluids through a manifold and central riser from a plurality of individual wells drilled in different parts of a field in deep water, which comprises:

a central manifold base having flow line connectors thereon;

an elongated boom for each well to be produced in a field, each boom being rigidly attached to the manifold base;

a temporary guide base mounted to the other end of each boom for establishing a well site; and a flow line extending along each boom from a flow line connector on the central manifold base.

20. Apparatus for subsea production of fluids through a central riser from a plurality of individual wells drilled in different parts of a field in deep water, which comprises:

a central manifold base of a multi-faceted configuration, the base having flow line connectors and stab receptaces thereon;

a manifold section to be landed on the manifold base, the manifold having connectors for making a connection with the stab receptacles on the base and with a production riser;

a downwardly facing, pyramid shaped funnel secured to the lower end of the manifold section;

an upwardly extending pyramid shaped structure for insertion within the funnel on the manifold section to provide lateral alignment, rotational orientation, and hard guidance of the manifold section during landing of the manifold section into position on the manifold base;

an elongated boom for each well to be produced in a field, each boom being articulated at one end to the periphery of the manifold base at a facet thereof and extending radially outward from the base, the length of each boom being such that a predetermined minimum spacing between the center of each well site and the manifold base is provided, with the lengths of adjacent booms differing to provide a predetermined minimum radial spacing between the centers of the well sites;

a temporary guide base mounted to the other end of each boom for establishing a well site;

a pre-installed flow line extending along the length of each boom from a flow line connector on the central manifold base and terminating in a vertical stab flow line connector receptacle;

a subsea tree for each well to be landed on a temporary guide base and having a connector for making an interconnection with the stab receptacle of a respective flow line; and means carried on each subsea tree for orienting the tree on its temporary guide base.

21. A method of producing well fluids from a number of individual wells drilled in different parts of a field located in deep water to a production platform via a central riser, which comprises the steps of:

submerging to the ocean floor a subsea production apparatus which includes a central manifold base having an elongated boom for each well articulated thereto at one end and mounting a temporary guide base at the other end of the boom for establishing a well site, and a preinstalled flow line extending along each boom from the manifold base;

landing a manifold section on the manifold; and landing a subsea tree on each temporary guide base.

* * * * *